US006152040A

United States Patent [19]

Riley et al.

[11] Patent Number: 6,152,040

[45] Date of Patent: Nov. 28, 2000

[54] SHAPED CHARGE AND EXPLOSIVELY FORMED PENETRATOR LINERS AND PROCESS FOR MAKING SAME

[75] Inventors: Michael A. Riley, Towson; Timothy J. Langan, Baltimore; David K. McNamara, Towson; Joseph R. Pickens, Glenelg, all of Md.

[73] Assignee: Ashurst Government Services, Inc., Baltimore, Md.

[21] Appl. No.: 08/999,751

[22] Filed: Nov. 26, 1997

[51] Int. Cl.[7] ..... F42B 1/02

[52] U.S. Cl. ..... 102/306; 102/307; 102/476; 419/28

[58] Field of Search ..... 102/306, 307, 102/476; 419/28, 6

[56] References Cited

U.S. PATENT DOCUMENTS

| | | | |
|---|---|---|---|
| 3,878,085 | 4/1975 | Corbant | 204/298 |
| 4,216,721 | 8/1980 | Marziano et al. | 102/306 |
| 4,551,287 | 11/1985 | Bethmann | 102/307 |
| 4,702,171 | 10/1987 | Tal et al. | 102/476 |
| 4,766,813 | 8/1988 | Winter et al. | 102/309 |
| 4,949,642 | 8/1990 | Wisotzki | 102/307 |
| 5,119,729 | 6/1992 | Nguyen | 102/307 |
| 5,331,895 | 7/1994 | Bourne et al. | 102/307 |

FOREIGN PATENT DOCUMENTS

| | | | |
|---|---|---|---|
| 2257497 | 1/1993 | United Kingdom | 102/307 |

*Primary Examiner*—Peter A. Nelson
*Attorney, Agent, or Firm*—David F. Dockery

[57] ABSTRACT

A shaped charge or explosively formed penetrator liner and a method for producing the liner. The liner is preferably formed from a metal having a fine, uniform grain structure. The liner is preferably produced by an electron beam deposition process.

19 Claims, 3 Drawing Sheets

SHAPED CHARGE AND EXPLOSIVELY FORMED PENETRATOR LINERS AND PROCESS FOR MAKING SAME

FIELD OF THE INVENTION

This invention relates to shaped charge and explosively formed penetrator devices and more particularly to a new and improved processing method that is capable of producing such devices with enhanced jet or penetrator performance by virtue of a refined grain structure. The liners are preferably produced by an electron-beam deposition manufacturing technique.

BACKGROUND OF THE INVENTION

Shaped charge and explosively formed penetrator (hereinafter referred to as SC/EFP) devices are used to develop holes in, and/or penetrate hard structures. SC/EFP devices incorporate a liner fabricated from pure metals, alloys, and/or ceramics which typically include elements such as chromium, copper, molybdenum, tantalum, tungsten, rhenium, osmium, niobium, platinum, iridium, hafnium, and uranium. It is the explosive formation of high velocity jets (SC's) and high velocity slugs (EFP's) of these metal and ceramic liners that form the penetrators capable of breaking through rock and other hard materials. Examples of such devices are disclosed in U.S. Pat. No. 4,498,367 by Skolnick et al.; U.S. Pat. No. 4,551,287 by Bethmann; U.S. Pat. No. 4,841,864 by Grace; and U.S. Pat. No. 4,958,569 by Mandigo. Each of these U.S. patents is incorporated herein by reference in their entirety.

The stability of the high velocity metal jet/slug determines the efficiency with which the target is penetrated. A highly stable, elongated jet exhibits superior penetration performance as compared to an unstable, short, segmented jet. The formation of high velocity jets via explosive forming is dependent upon a variety of material properties inherent in the base material of the SC/EFP liner. Favorable properties include, but are not limited to, high melting temperature, high density, high bulk speed of sound, fine grain size, proper grain orientation, good elongation, minimal fabrication imperfections, low impurity content, high dynamic strength and high dynamic toughness. Some salient properties for a variety of potential SC/EFP liner materials are illustrated in Table I.

TABLE I

Potential High Melting Point SC/EFP Liner Materials

| Material | Melting Point (° C.) | Density (g/cm$^3$) | Crystal Structure |
|---|---|---|---|
| W | 3407 | 19.3 | BCC |
| Os | 3027 | 22.4–22.7 | Hexagonal |
| Ta | 3014 | 16.6 | BCC |
| Mo | 2618 | 10.2 | BCC |
| Nb | 2467 | 8.55 | BCC |
| Ir | 2443 | 22.5 | FCC |
| Ru | 2250 | 12.2 | Hexagonal |
| Hf | 2227 | 13.1 | Hexagonal |
| Re | 1964 | 21.0 | Hexagonal |
| V | 1902 | 5.80 | BCC |
| Cr | 1857 | 7.19 | BCC |
| Pt | 1772 | 21.4 | FCC |
| Th | 1755 | 11.7 | FCC |
| Ti | 1669 | 4.50 | Hexagonal |
| Fe | 1536 | 7.86 | BCC |
| U | 1132 | 18.9 | Orthorhombic |

The probability of high dynamic ductility is greater in BCC and FCC metals due to the presence of more slip systems in these lattices than in hexagonal lattices.

Current SC/EFP liners exhibit limitations due to material property constraints. Current manufacturing techniques for SC/EFP liners include the following: 1) casting processes; 2) forming processes, including powder metallurgy techniques, hot working techniques and cold working techniques; 3) machining processes; and 4) other techniques such as grinding and metallizing. In particular, current technologies for the formation of liners are believed to limit the minimum grain size in the liner to between about 5 and 100 micrometers, depending on the specific material. Finer grained SC/EFP liners would exhibit enhanced performance resulting from the formation of a more stable jet. However, materials with extremely fine grain size are generally not available for this purpose.

SC/EFP liners with a submicron grain size have been fabricated by a chemical vapor deposition (CVD) process, specifically by forming liners of tungsten and rhenium using tungsten hexafluoride and rhenium hexafluoride. Although these liners have a fine grain size, they possess chemical impurities that produce deleterious effects on the jet formation from the liner. In addition, the CVD process is, in general, quite slow and expensive.

In addition to the limitations discussed above, current manufacturing technologies frequently require expensive machining steps to produce the high precision metal liners for SC/EFP devices. In particular, many processes for the production of liners from higher density materials currently require the removal of large quantities of metal after the liner is first produced. It is estimated that about 80% of the cost associated with the formation of tungsten shaped charge liners is associated with the machining process.

Still another material limitation pertains to variations in the microstructure of forgings used to fabricate SC/EFP liners. This lack of a uniform starting material results in inconsistencies in the performance of the liners. EFP liners made by slicing disks of metal from a forging will have microstructural differences based upon the location of the slice in the forging. These positional differences can cause major performance differences in the functioning of the device. The fabrication of liners via the forging approach is also limited due to difficulties in obtaining forgings of the appropriate size for metals such as molybdenum and tungsten.

SUMMARY OF THE INVENTION

According to an embodiment of the present invention, a process is provided for producing SC/EFP liners with finer grain size than those which exist in current technology. The process substantially eliminates the costly machining steps currently required to fabricate SC/EFP liners, and produces SC/EFP liners with fine-grained, uniform microstructures and compositions.

DESCRIPTION OF THE INVENTION

Figure 1:
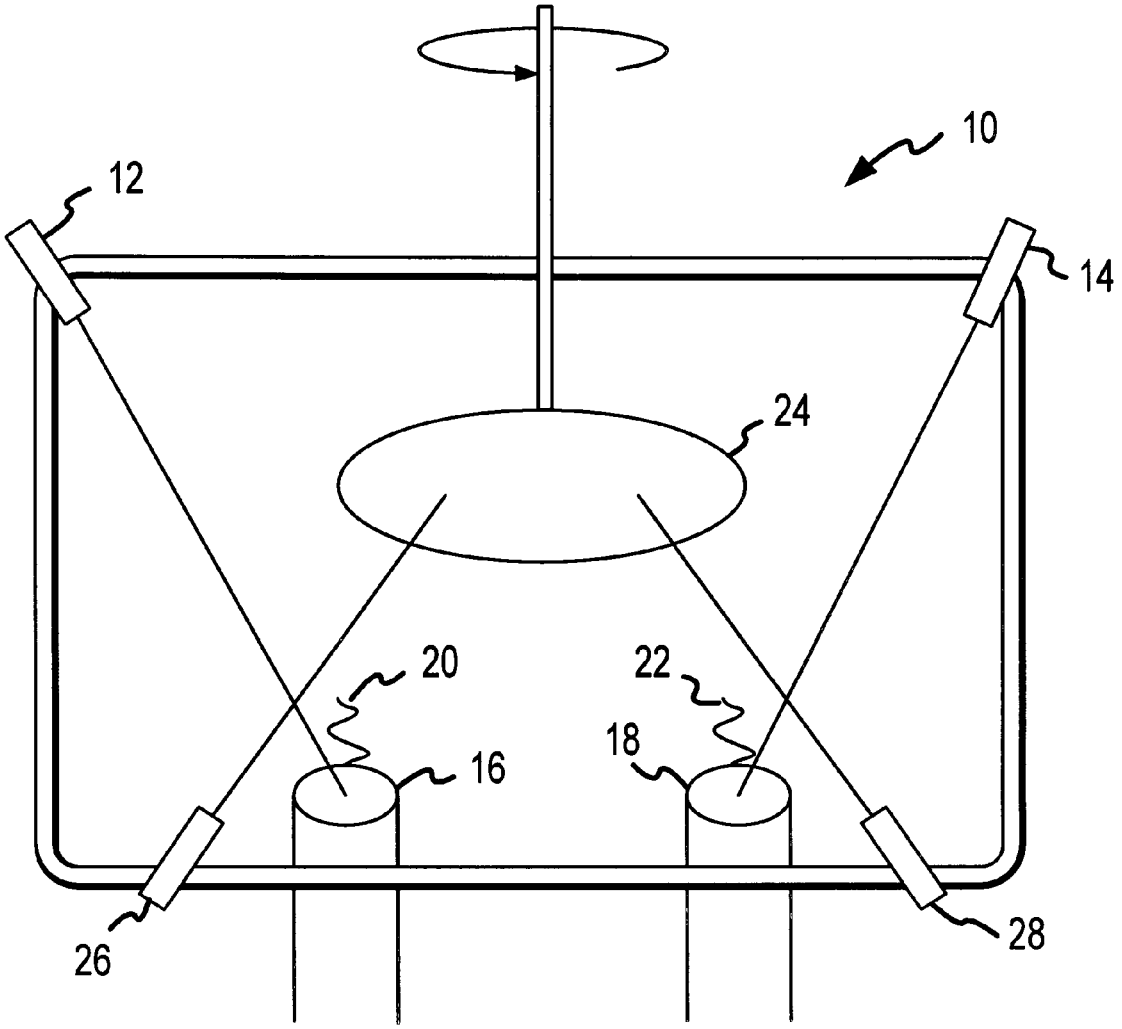
FIG. 1 illustrates an apparatus useful for carrying out a process according to an embodiment of the present invention.

The present invention is directed to a process for the production of an SC/EFP liner, as well as an SC/EFP liner having unique characteristics. The preferred process is an electron beam deposition process wherein a source of liner material is heated to the vaporization point and is then condensed onto a substrate. The resulting microstructure is fine-grained and provides advantages over SC/EFP liners known in the art.

A particular advantage of the electron-beam process embodied in the present invention is the deposition of the condensate with a very uniform and well-controlled microstructure. In addition, the electron-beam process is capable of a very high rate of material deposition. In general, careful control of deposition and substrate temperature are desired to achieve tailored microstructures. The electron-beam process permits complete independent control of these parameters, unlike other deposition processes. The electron-beam process can be used for the construction of solid objects, rather than mere coatings, due to the rapid material deposition rates that can be achieved. For example, in sufficiently large-scale implementations, electron beam processes are capable of depositing copper at a rate of over 2 mm per hour, which makes the construction of an entire SC/EFP liner economically practical. Further, the process permits the deposition of different materials as microlayers, to form SC/EFP liners having a bilayer (two materials) or a multilayer laminate structure.

To this end, the present invention consists of a process to produce a SC/EFP liner in near-net-shape from a variety of materials, the liner advantageously possessing a microstructure with a fine grain size. Preferably, the average grain size is less than about 10 micrometers and more preferably is less than about 5 micrometers, and even more preferably is less than about 1 micrometer. The liner also has a high purity, preferably having less than about 0.01 weight percent impurities. The near-net shape attribute of the SC/EFP liner is obtained by condensing the material of interest from a vapor phase directly onto an appropriately designed substrate, that is, a substrate that replicates the shape of the liner, such as the inner surface of the liner.

Specifically, electron-beams from electron beam guns are used to vaporize materials from one or more high purity sources of liner material under a vacuum and the resulting vapor steam condenses under controlled conditions onto a substrate, preferably one that possesses the internal shape of a SC liner or the back wall shape of an EFP liner. Preferred liner materials include, but are not limited to, the following: chromium, copper, molybdenum, tantalum, tungsten, rhenium, osmium, niobium, hafnium, uranium, platinum, iridium, titanium or ceramics or alloys containing these elements. A particularly preferred liner material is copper metal. Copper metal is inexpensive and has good properties for use in an SC/EFP liner. When using copper or a copper alloy as a liner material, it may be advantageous to also incorporate small amounts (e.g. less than about 1 weight percent) of a grain refiner such as a carbide, an oxide, a nitride or a boride.

The electron beam deposition technique provides a liner preform having a near-net shape with minimal excess material expended from the metal target. Liners produced by this technique can possess the dimensional tolerances of currently manufactured SC/EFPs and can be attached to SC/EFP explosive devices in the same manner as current systems. No special handling procedures are required for the new SC/EFP liners.

In manufacturing practice, the substrate upon which the SC/EFP liner preform is deposited may conform to the exact shape of the wall of the SC/EFP or it may provide for the formation of a liner that is slightly oversized to allow for finish machining. This step may be desirable to ensure the uniformity of the inner wall of the SC/EFP. Moreover, the preparation of the SC/EFP may be facilitated by a preparatory deposition of a release coating on the substrate to ensure the ready removal of the SC/EFP liner. The substrate is preferably rotated during deposition of the liner material to ensure uniform deposition. The substrate upon which the liner material is deposited should also be heated to attain the desired grain structure. Preferably, the substrate is heated to at least about 0.5 Tm, more preferably at least about 0.8 Tm, where Tm is the melting point of the liner material.

FIG. 1 illustrates an apparatus 10 useful for carrying out an electron beam deposition process according to an embodiment of the present invention. The apparatus includes electron beam guns 12 and 14 which are directed at first and second sources of liner material, 16 and 18. Upon heating of the liner material by the electron beam guns, a vapor 20 and 22 of the liner materials is formed and condenses upon a rotating substrate 24. The rotating substrate 24 can also be heated using electron guns 26 and 28.

Figure 2:
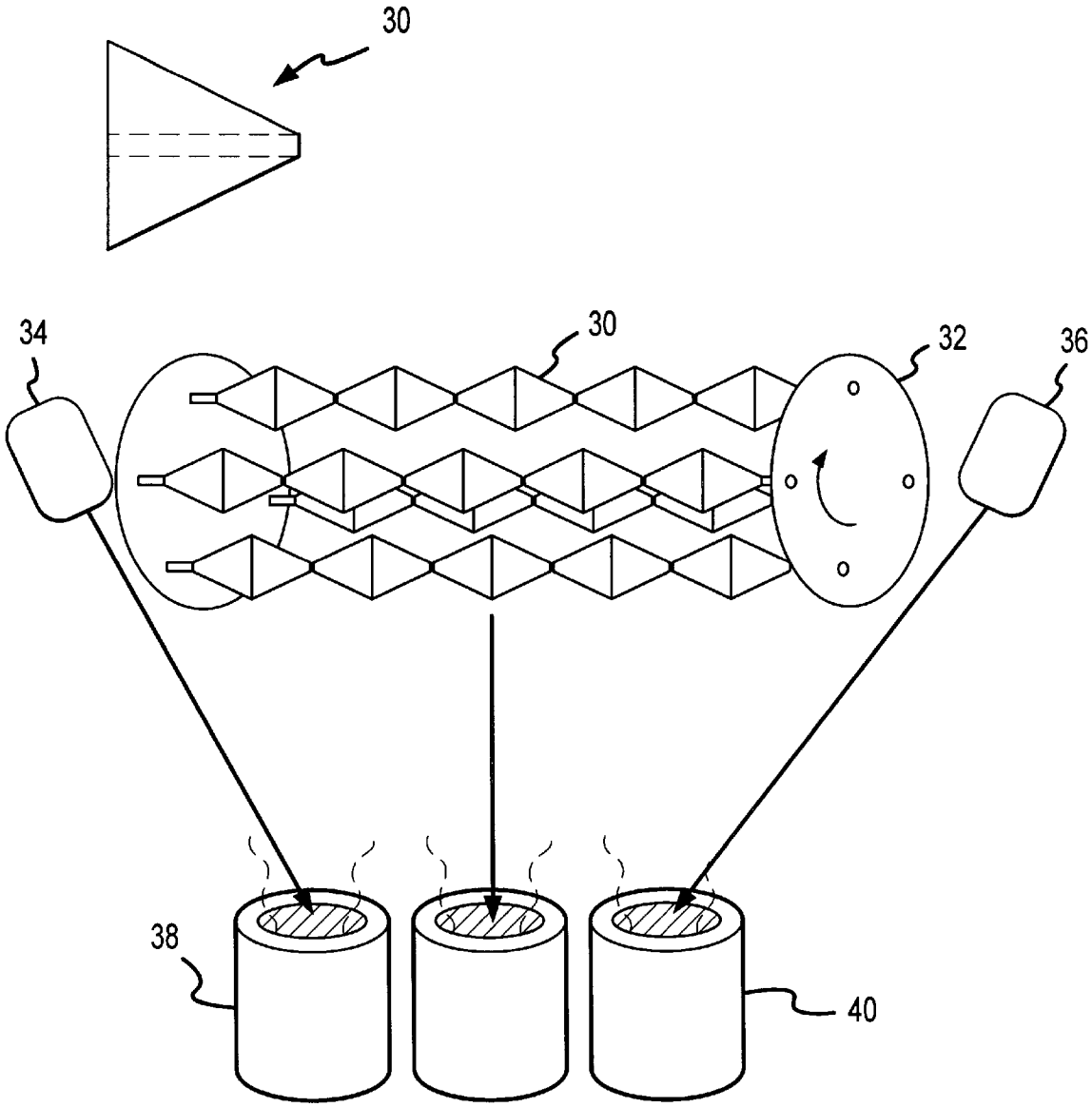
FIG. 2 illustrates an apparatus useful for carrying out a process according to an embodiment of the present invention.

FIG. 2 illustrates a cone-shaped substrate for forming a near-net shape liner preform along with an apparatus utilizing a plurality of cone-shaped substrates upon a rotating rotisserie-style substrate holder. The cone-shaped substrate 30 generally has the shape of the shaped charge liner. A plurality of such substrates 30 can be arranged as illustrated in FIG. 2 as a rotating rotisserie style holder 32. As the substrate holder 32 rotates, electron beam guns 34 and 36 are directed at crucibles containing liner material 38 and 40 which then evaporates and condenses upon the cone shaped substrates 30. In this way, a large number of liner preforms can be formed simultaneously.

The electron-beam process advantageously allows multilayer structures, such as bilayer structures, to be formed that bestow advantageous properties to a SC/EFP liner. For example, osmium and iridium are the densest elements, but their high cost makes them unlikely candidates for liners. Iridium, with its face centered cubic structure, has many slip systems which are necessary for high dynamic elongation, which makes it a particularly attractive candidate for SC/EFPs. According to the present invention, a relatively thin iridium layer can be deposited on a lower cost copper liner, for example. Furthermore, the electron-beam process allows precise control of the thickness of the copper and iridium layers to achieve a liner in which the higher melting point, higher density iridium forms the lead portion of the jet. The grain textures of the two layers can be controlled to optimize high strain rate behavior during jet formation.

The electron beam deposition process is capable of producing individual layers as thin as about 0.1 micrometers of any of the materials previously mentioned, and can arrange their layered structure in any repeating or random order. This ability permits the use of higher density materials on the inner walls on liners, so as to position them in the front of the jet as it is formed. These layered liners may be used to impart benefits of higher density, deformation control, chemical reactivity (pyrophoricity), etch

EXAMPLES

An electron beam process substantially as described hereinabove was utilized to form a fine grained copper metal condensate suitable for fabricating SC/EFP's.

Figure 3:
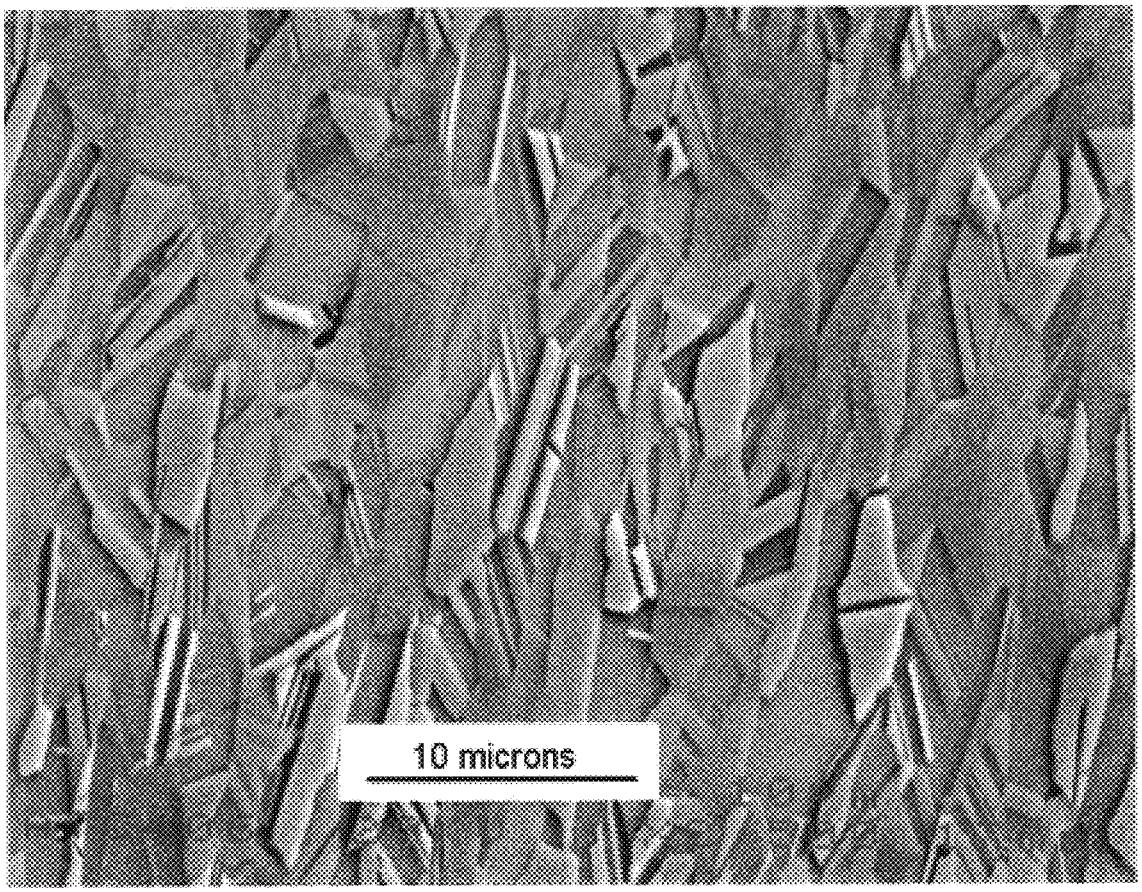
FIG. 3 illustrates a scanning electron micrograph of the microstructure of a copper-based liner preform according to an embodiment of the present invention.

The condensate had a thickness of about 5 millimeters. The microstructure of the condensate is illustrated in FIG. 3. The average grain size of the copper metal was less than about 5 $\mu$m.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A process for the production of an SC/EFP liner, comprising the steps of:

(a) providing a first source of a first liner material;

(b) heating said first source of first liner material to vaporize at least a portion of said first liner material;

(c) condensing said vaporized first liner material onto a substrate to form an SC/EFP liner preform;

(d) cooling said SC/EFP liner preform;

(e) removing said SC/EFP liner preform from said substrate; and (f) forming said SC/EFP liner preform into an SC/EFP liner.

2. A process as recited in claim 1, wherein said SC/EFP liner has an average grain size of less than about 10 micrometers.

3. A process as recited in claim 1, wherein said SC/EFP liner has an average grain size of less than about 5 micrometers.

4. A process as recited in claim 1, wherein said first liner material is a metal.

5. A process as recited in claim 1, wherein said first liner material is a metal selected from the group consisting of chromium, copper, molybdenum, tantalum, tungsten, rhenium, osmium, platinum, iridium, titanium and alloys thereof.

6. A process as recited in claim 1, wherein said first liner material is a ceramic.

7. A process as recited in claim 1, wherein said SC/EFP liner has an impurity level of less than about 0.01 weight percent.

8. A process as recited in claim 1, wherein said substrate is adapted to produce a near net shape that substantially replicates the inner surface of said SC/EFP liner.

9. A process as recited in claim 1, wherein said process further comprises the steps of providing a second source of liner material, heating said second source to vaporize at least a portion of said second liner material and condensing said vaporized second liner material on said substrate.

10. A process as recited in claim 9, wherein said second source of liner material is vaporized after condensation of said first liner material to form a SC/EFP liner having a bilayer structure.

11. A process as recited in claim 9, wherein said first source and said second source are heated simultaneously to condense and form a multilayer laminate SC/EFP liner.

12. A process as recited in claim 9, wherein said first liner material is copper or an alloy of copper.

13. A process as recited in claim 1, wherein said substrate is rotated during said condensing step.

14. A process as recited in claim 1, wherein said heating step comprises directing an electron beam at said first source.

15. A process as recited in claim 1, wherein said forming step comprises machining said liner preform.

16. A process for the production of a metal SC/EFP liner, comprising the steps of:

(a) providing a copper metal source;

(b) heating said copper metal source by directing electron beams at said copper metal source to vaporize at least a portion of said copper metal;

(c) condensing said vaporized copper metal on a substrate to form on SC/EFP liner preform;

(d) cooling said SC/EFP liner preform;

(e) removing said SC/EFP liner preform from said substrate; and (f) forming an SC/EFP liner from said SC/EFP liner preform.

17. A process as recited in claim 16, further comprising the step of rotating said substrate during said condensing step.

18. A process as recited in claim 16, further comprising the steps of heating a second metal source to vaporize at least a portion of said second metal source and condensing said second metal on said substrate.

19. A process as recited in claim 16, wherein said substrate is adapted to produce a near net shape that substantially replicates the inner surface of said SC/EFP liner.

* * * * *